US007222497B2

(12) United States Patent
An et al.

(10) Patent No.: US 7,222,497 B2
(45) Date of Patent: May 29, 2007

(54) ICE MAKER HAVING FAN ASSEMBLY AND FAN ASSEMBLY CONTROL METHOD

(75) Inventors: Si-Yoen An, Gimhae (KR); Bom-Sik Lee, Busan (KR); Oh-Chul Kwon, Changwon (KR); Ill-Shin Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 78 days.

(21) Appl. No.: 10/531,982

(22) PCT Filed: Oct. 20, 2003

(86) PCT No.: PCT/KR03/02191

§ 371 (c)(1),
(2), (4) Date: Apr. 20, 2005

(87) PCT Pub. No.: WO2004/036127

PCT Pub. Date: Apr. 29, 2004

(65) Prior Publication Data

US 2006/0010900 A1 Jan. 19, 2006

(30) Foreign Application Priority Data

Oct. 21, 2002 (KR) ..... 10-2002-0064367
Oct. 21, 2002 (KR) ..... 10-2002-0064368

(51) Int. Cl.
*F25C 1/00* (2006.01)

(52) U.S. Cl. ..... 62/353; 415/213.1; 415/214.1
(58) Field of Classification Search ..... 62/66–74, 62/340–356; 415/211.2, 213.1, 214.1

See application file for complete search history.

(56) References Cited

U.S. PATENT DOCUMENTS 6,024,536 A * 2/2000 Tsubakida et al. ..... 416/189
6,050,774 A * 4/2000 LeBaron ..... 415/121.2
6,351,955 B1 3/2002 Oltman et al.
6,588,227 B2 * 7/2003 Kim et al. ..... 62/344
6,732,537 B1 * 5/2004 Anell et al. ..... 62/71

FOREIGN PATENT DOCUMENTS

KR 2001-0017165 A 3/2001

* cited by examiner

*Primary Examiner*—William E. Tapolcai
(74) *Attorney, Agent, or Firm*—Birch, Stewart, Kolasch, & Birch, LLP

(57) ABSTRACT

The present invention relates to an ice maker having a fan assembly. The ice maker 30 of the present invention comprises a main body 40 and a fan assembly 60 mounted to the main body 40 by means of resilient mounting hooks. A housing 62 defines an external appearance of the fan assembly 60, and comprises first and second housing portions 62*a* and 62*b*. The first and second housing portions 62*a* and 62*b* are provided with concavo-convex coupling portions 63 and 63' at positions corresponding to each other so that the housing portions can be provisionally assembled by coupling the concavo-convex coupling portions to each other. The interiors of the first and second housing 62*a* and 62*b* are partitioned by partition plates 64 to define a cold air flow passage 64*f*, and a discharge duct 66 is formed integrally to communicate with the cold air flow passage 64*f*. A box fan unit 80 is installed in the cold air flow passage 64*f*, and mounting ribs 65 and 65' corresponding to opposite corners of the box fan unit 80 are formed on the first and second housing portions 62*a* and 62*b*. The first and second housing portions 62*a* and 62*b* are coupled to each other by fastening the box fan unit 80 to the mounting ribs 65 and 65' by means of screws. A housing cover 70 formed with an inlet 72 communicating the cold air flow passage 64*f* is installed at a side of the housing 62. A fastening rib 74 of the housing cover 70 is simultaneously fastened together with the first and second housing portion 62*a*, 62*b* by means of a screw.

7 Claims, 7 Drawing Sheets

ICE MAKER HAVING FAN ASSEMBLY AND FAN ASSEMBLY CONTROL METHOD

TECHNICAL FIELD

The present invention relates to an ice maker, and more particularly, to an ice maker having a fan assembly, wherein cold air is supplied to an ice-making tray of the ice maker so that ice can be more rapidly made.

BACKGROUND ART

A refrigerator is provided with an ice maker to make and provide ice to a user. In the ice maker, cold air with relatively low temperature within the refrigerator is supplied to a tray of the ice maker so that ice can be more rapidly made. A conventional ice maker with such a structure is shown in FIG. 1.

According to the ice maker as shown in the figure, a main body 1 of the ice maker is provided with an ice-making tray 3. Generally, the ice-making tray 3 is a portion in which ice is actually made, and is partitioned into a plurality of spaces. Reference numeral 5 is an ice-detecting lever. A driving unit 7 in which a driving motor for driving the ice-making tray 3 and the ice-detecting lever 5 is located is provided at a side of the main body 1 of the ice maker.

A fan assembly 10 is detachably installed at the driving unit 7. The fan assembly 10 forcibly supplies cold air toward the ice-making tray 3 to more rapidly make ice.

The structure of the fan assembly 10 will be described in detail with reference to FIG. 2. A housing 12 defines an external appearance of the fan assembly 10. A fan housing 14 is installed within the housing 12. A sirocco fan 16 is installed within the fan housing 14. The sirocco fan 16 serves to cause cold air to flow toward the ice-making tray 3. The sirocco fan 16 is driven by a fan motor 15 installed at a side of the fan housing 14.

A duct housing 17 is provided at a side of the housing 12. An inlet 18 is formed at a side of the duct housing 17. The inlet 18 is a passage through which cold air within the refrigerator is introduced into the housing 12 by means of the sirocco fan 16. A discharge duct 19 is provided integrally at a side of the duct housing 17. An outlet 20 that is open toward a lower portion of the ice-making tray 3 is formed at an end of the discharge duct 19. The cold air forcibly delivered by the sirocco fan 16 is discharged through the outlet 20.

Further, a housing cover 22 is provided to define a side surface of the housing 12, more specifically, a surface of the housing 12 opposite to the main body 1 of the ice maker. The housing cover 22 defines a side surface of the external appearance of the fan assembly 10. The housing cover 22 is provided with a switch 23 for manipulating the fan motor 15.

Meanwhile, in the conventional ice maker with the fan assembly constructed as above, the operation of the fan assembly is controlled as follows. The sirocco fan 16 is driven only when the ice maker is operated. That is, in order to reduce time required for making ice, the sirocco fan 16 is driven after water is supplied to the ice maker. Accordingly, the sirocco fan 16 is not driven during the ice maker is not operated.

First, water is supplied into the ice-making tray 3. This step is performed by operating a water-supplying valve for a period of time that has been already set in a control unit. When the supply of water is completed, the control unit applies a driving signal so that electric power can be supplied to the fan motor 15. The fan motor 15 is driven in response to the driving signal and generates power for rotating the sirocco fan 16.

Here, the rotating operation of the sirocco fan 16 is performed until water supplied to the ice-making tray 3 is frozen into ice and thus the process of making ice is completed. Accordingly, the control unit detects temperature through a temperature-detecting unit for detecting temperature at the ice-making tray 3 and continuously drives the sirocco fan 16 until the detected temperature is reached to a predetermined value.

When the temperature detected through the temperature-detecting unit is equal to temperature that has been already set for a moment when the process of making ice is completed, the control unit controls an ice-releasing operation. Prior to this, the control unit outputs a control signal for cutting off the electric power supplied to the fan motor to stop the rotating operation of the sirocco fan 16. Therefore, when the electric power supplied to the fan motor 15 is cut off, the power for rotating the fan 16 is also cut off.

Further, the control unit outputs a signal to a motor that is provided in the driving unit 7. Then, the motor generates power for releasing the ice. The ice-releasing power is transmitted to an ice-releasing lever that in turn is rotated to release the ice from the ice-making tray 3. The released ice is stored in an ice storage container located below the ice-making tray.

When the ice-releasing operation is completed, the control unit restarts the sirocco fan 16. That is, the control unit performs control to again supply the electric power to the fan motor so that the fan motor 15 can be operated. In such a way, the sirocco fan 16 is rotated again.

Meanwhile, after the control unit performs the ice-releasing operation, it performs the process of checking the amount of ice stored in the ice storage container in order to determine whether to perform the process of making ice again. To this end, power for an ice-detecting operation is supplied from the motor in the driving unit 7.

The ice-detecting lever 5 is rotated by means of the power generated as above and determines whether the ice storage container has been fully filled with ice. When the ice-detecting lever 5 comes into contact with ice and is restricted in view of its rotating range during rotation thereof, a micro switch constructed to be mechanically interlocked with the ice-detecting lever 5 is operated to generate a signal according to the full state of the ice and transmit the signal to the control unit.

Once the control unit recognizes that the ice storage container is fully filled with the ice, the control unit no longer controls the ice-making operation. Then, the control unit applies a signal for cutting off the electric power supplied to the fan motor so as to stop the operation of the fan motor 15. Here, since the ice-making operation is no longer performed, the rotation of the fan 16 is also limited. However, if a state where the ice storage container is not fully filled with ice is detected, the control unit repeatedly performs control of the water-supplying operation, the ice-making operation and the ice-releasing operation.

However, there are the following problems in the prior art.

First, a relatively great number of parts are required to construct the fan assembly 10. The additional fan motor 15 is required for driving the fan 16 and the fan housing 14 is required for guiding an air stream formed by the fan 16. Further, about ten (10) screws are needed for fastening the fan housing, the housing 12, the duct housing 17 and the housing cover 22 to one another.

Accordingly, the conventional ice maker has problems in that it is difficult to manage constituent parts and manufacturing costs are increased due to the large number of parts, and assembly workability is deteriorated due to a plurality of screwing operations for assembling the parts.

Further, the fan motor 15 constituting the conventional fan assembly 10 is an AC motor that has a relatively large volume and heavy weight. Moreover, since the fan housing 14 is provided in the fan assembly 10, the entire weight of the fan assembly 10 is increased. Accordingly, considering the ice maker as a whole, the center of gravity of the ice maker is biased toward the fan assembly 10 and thus there is a problem in that the design of installation of the ice maker is complicated.

Furthermore, since openings of the inlet 18 and outlet 20 do not exit on a straight line in the conventional fan assembly 10, the flow of cold air is not smooth relatively. That is, there is a problem in that a relatively large loss of the flow of the cold air which flows within the fan assembly 12 is produced.

Meanwhile, the conventional ice maker is controlled such that ON/OFF operations of the fan are performed twice during one (1) cycle including the water-supplying operation, the ice-making operation, the ice-releasing operation and the operation for detecting the state where the ice storage container is fully filled with ice. That is, the ON/OFF operation of the fan is performed once during the process of releasing ice, and the ON/OFF operation of the fan is performed once again after the process of detecting the state where the ice storage container is fully filled with ice and the process of supplying water.

In the conventional ice maker controlled as described above, there is a problem in that the ON/OFF operations of the fan are unnecessarily performed since the fan is operated twice during one cycle, thereby shortening the life of the fan.

DISCLOSURE OF INVENTION

Accordingly, the present invention is conceived to solve the problems in the prior art. An object of the present invention is to provide a fan assembly having simplified constituent parts.

Another object of the present invention is to provide an ice maker of which the center of gravity substantially coincides with the geometrical center thereof.

A further object of the present invention is to establish a straight flow of cold air passing through a fan assembly of an ice maker.

A still further object of the present invention is to provide a method of controlling a fan in an ice maker having a fan assembly, wherein unnecessary ON/OFF operations of the fan are inhibited, thereby increasing the life of the fan.

According to an aspect of the present invention for achieving the objects, there is provided an ice maker having a fan assembly, comprising a main body constructed such that an ice-making tray in which ice is made is pivotably supported to a main body frame of the main body; and a fan assembly mounted to the main body frame of the main body to supply cold air to the ice-making tray. The fan assembly comprises a housing including first and second housing portions of which the interiors are partitioned by partition plates to define a cold air flow passage and which form a discharge duct that communicates with the cold air flow passage to supply the cold air to the ice-making tray; a box fan unit which is fixed in the cold air flow passage defined within the first and second housing portions while coupling the first and second housing portions to each other and supplies power for forcibly delivering the cold air; and mounting hooks for resiliently hanging and mounting the first and second housing portions on the main body frame.

The first and second housing portions may have concavo-convex coupling portions formed such that concave and convex portions of one of the first and second housing portions correspond to convex and concave portions of the other housing portion, thereby setting relative positions of the housing portions and provisionally assembling the housing portions.

The housing comprising the first and second housing portions may be provided with a housing cover on a side thereof opposite to the main body frame, and the housing cover may be formed with an inlet to supply the cold air to the cold air flow passage.

Each of the first and second housing portions may be provided with mounting ribs for fixing the box fan unit, and the first and second housing portions may be coupled to each other by fixing the box fan unit to the mounting ribs.

One of the housing portions of the housing may be formed with a recess that has a fastening hole formed therethrough, and the housing cover may be provided with a fastening rib which is seated in the recess and fastened by means of a screw that passes though the fastening hole and is fastened to the other housing portion.

The housing cover may have a hanging rib formed at one side thereof and a catching rib may be formed on the housing at a position corresponding to the hanging rib such that the hanging rib can be hung on the catching rib, and the housing cover may be guided to an installation position thereof as the fastening rib is seated in the recess of the housing portion.

The inlet formed in the housing cover, the flow passage defined within the housing, and the discharge duct and an outlet thereof may exist on a straight line.

According to another aspect of the present invention, there is provided a method of controlling an ice maker which has a fan assembly for supplying cold air to an ice-making tray and in which an ice-making operation, an ice-releasing operation, a water-supplying operation and an operation for detecting a full level state of ice are controlled automatically, comprising a fan driving step of driving a fan assembly to supply the cold air to the ice-making tray during the ice-making operation is performed; and a fan stopping step of stopping the fan before the ice-releasing operation is performed, and performing the fan driving step again after checking ice release, water supply and the full level state of ice.

According to a further aspect of the present invention, there is provided a method of controlling an ice maker having a fan assembly for supplying cold air to an ice-making tray, comprising a first step of operating the fan assembly; a second step of monitoring whether an ice-making operation has been completed, in a state where the fan assembly is operated; a third step of stopping the fan assembly when the ice-making operation has been completed; a fourth step of performing an ice-releasing operation and a water-supplying operation after the fan assembly is stopped; and a fifth step of performing an operation for detecting a full level state of ice after the water-supplying operation, and returning to the first step and repeating the above steps if the full level state of ice is not detected, or standing by until the full level state is released if the full level state is detected.

BEST MODE FOR CARRYING OUT THE INVENTION

Figure 1:
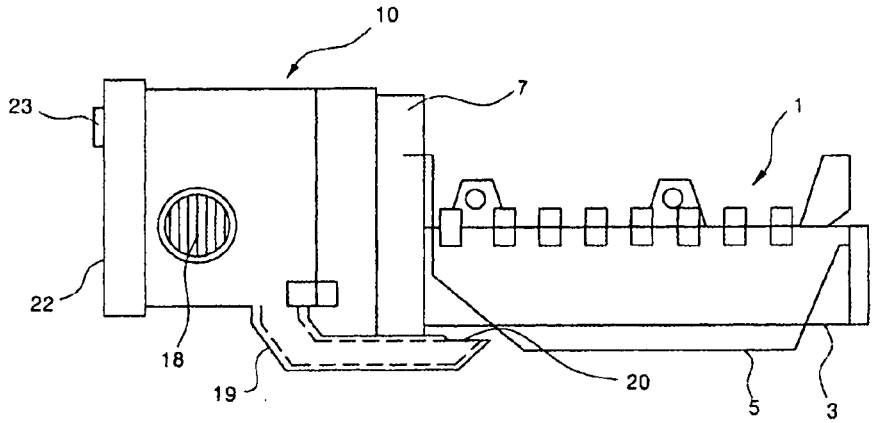
FIG. 1 PRIOR ART
FIG. 1 is a side view showing the structure of a conventional ice maker with a fan assembly.
Figure 2:
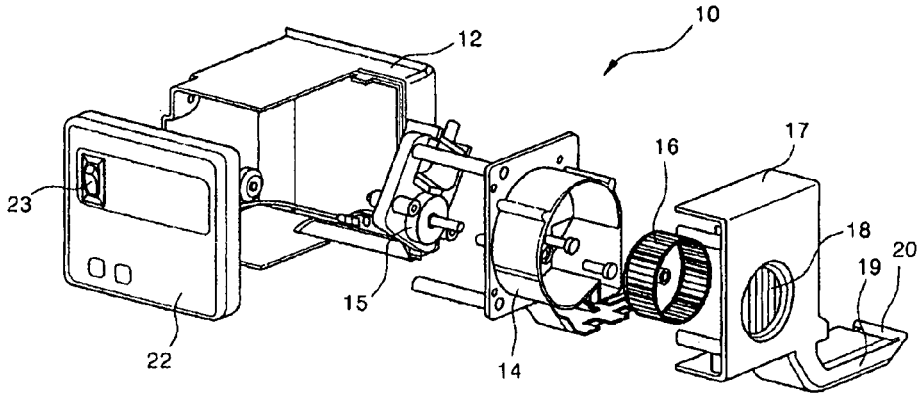
FIG. 2 PRIOR ART
FIG. 2 is an exploded perspective view showing the structure of the fan assembly for use in the conventional ice maker.
Figure 3:
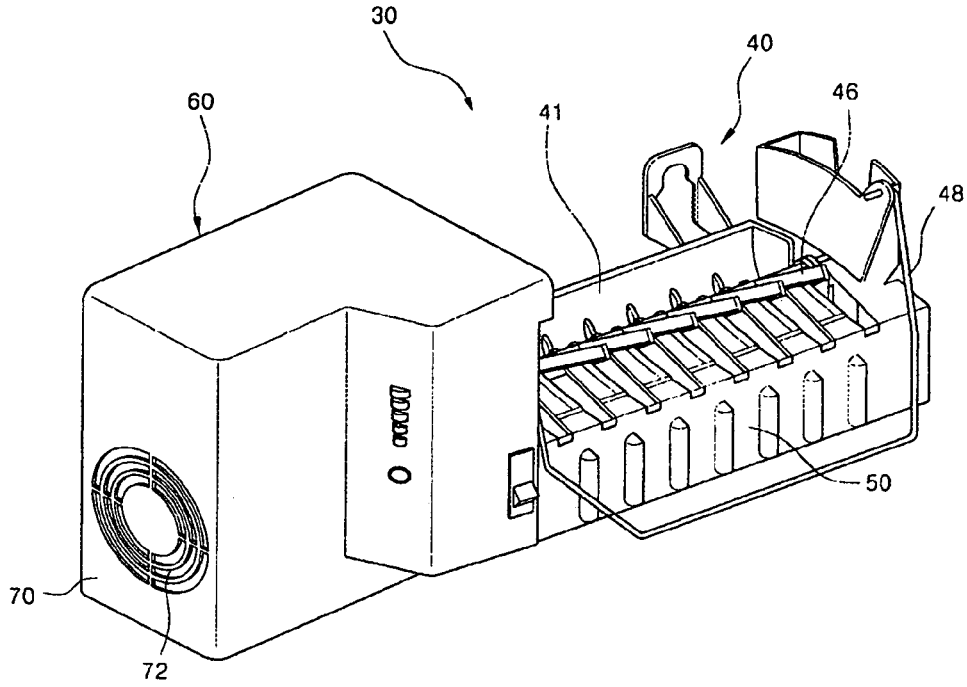
FIG. 3 is a perspective view showing an external appearance of a preferred embodiment of an ice maker with a fan assembly according to the present invention.

Hereinafter, a preferred embodiment of an ice maker with a fan assembly according to the present invention will be described in detail with reference to the accompanying drawings.

Referring to the drawings, an ice maker 30 of this embodiment comprises a main body 40. The main body 40 of the ice maker is provided with a main body frame 41. Fixing rings 41' are formed integrally at the main body frame 41 so that the ice maker 30 can be mounted on a side of a refrigerator. A variety of parts constituting the ice maker 30 are mounted to the main body frame 41. To this end, first and second mounting frame portions 42 and 43 are provided at a side of the main body fame 41. A predetermined space is provided between the first and second mounting frame portions 42 and 43, and a variety of parts are installed in the space between the first and second mounting frame portions.

An ice-making tray 45 is pivotably installed at the main body frame 41. The ice-making tray 45 is a portion in which ice is made. An end portion of the ice-making tray 45 is connected to a driving motor 52, which will be described below, through the first mounting frame portion 42. Reference numeral 46 designates ice-releasing lever for transferring ice made in the ice-making tray 45 to a separate storage container, reference numeral 48 designates an ice-detecting lever for detecting the amount of ice in the storage container, and reference numeral 50 designates a tray cover.

Meanwhile, the driving motor 52 for operating the ice-making tray 45, the ice-releasing lever 46 and the ice-detecting lever 48 is installed between the first and second mounting frame portions 42 and 43. Parts including gears for transmitting power from the driving motor 52 to the ice-making tray 45, the ice-releasing lever 46 and the ice-detecting lever 48 are provided between the first and second mounting frame portions 42 and 43. Reference numeral 54 designates a control unit.

A fan assembly 60 is mounted to a side of the main body 40 of the ice maker. The fan assembly 60 forcibly directs cold air within the refrigerator toward the ice-making tray 45 so that ice can be more rapidly made.

A housing 62 defines an external appearance of the fan assembly 60. The housing 62 is constructed by coupling a first housing portion 62*a* and a second housing portion 62*b* to each other. The first and second housing portions 62*a* and 62*b* are located respectively at left and right sides with respect to the flow of the forcibly delivered cold air to construct the housing 62. In order to couple the first and second housing portions 62*a* and 62*b* to each other, a fastening hole 62*h* is formed in a recess 62*h'* indented toward to the interior of the first housing portion 62*a* at one end thereof, and a fastening rib 62*r* protrudes at a position in the second housing portion 62*b*, which corresponds to the position of the fastening hole. A fastening hole 62*h* corresponding to the fastening hole 62*h* is formed at the fastening rib. A catching rib 62*g* on which a housing cover 70 to be described later is hung is formed vertically along one end of the second housing portion 62*a*.

Concavo-convex coupling portions 63 and 63' for provisional assembly of the first and second housing portions 62*a* and 62*b* are formed at opposite positions in the first and second housing portions 62*a* and 62*b*, respectively. The concavo-convex coupling portions 63 and 63' are formed on the bottoms of upper surfaces and the tops of lower surfaces of the first and second housing portions 62*a* and 62*b*, respectively. Protruding portions of the concavo-convex coupling portions 63 and 63' extend toward the opposite ones of the first and second housing portions 62*a* and 62*b*, respectively, and recessed portions of the concavo-convex coupling portions 63' and 63 of the other ones of the housing portions 62*b* and 62*a* are formed to correspond to the protruding portions. These concavo-convex coupling portions 63 and 63' serve to allow the first and second housing portions 62*a* and 62*b* to be provisionally assembled and to be prevented from being moved relatively toward the main body 40 of the ice maker.

Figure 4:
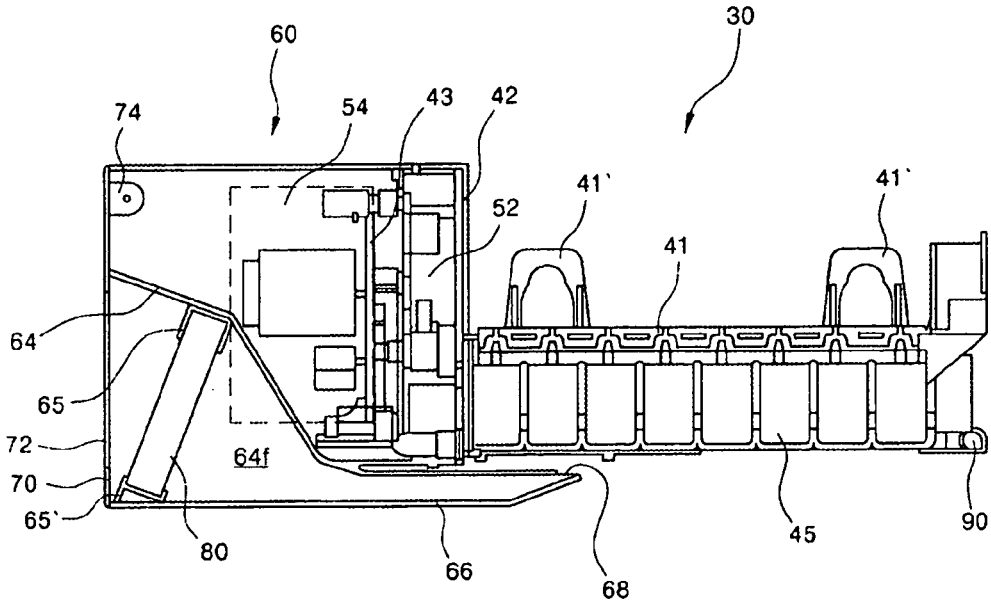
FIG. 4 is a partially sectional side view showing the structure of a major portion of the embodiment of the present invention.
Figure 5:
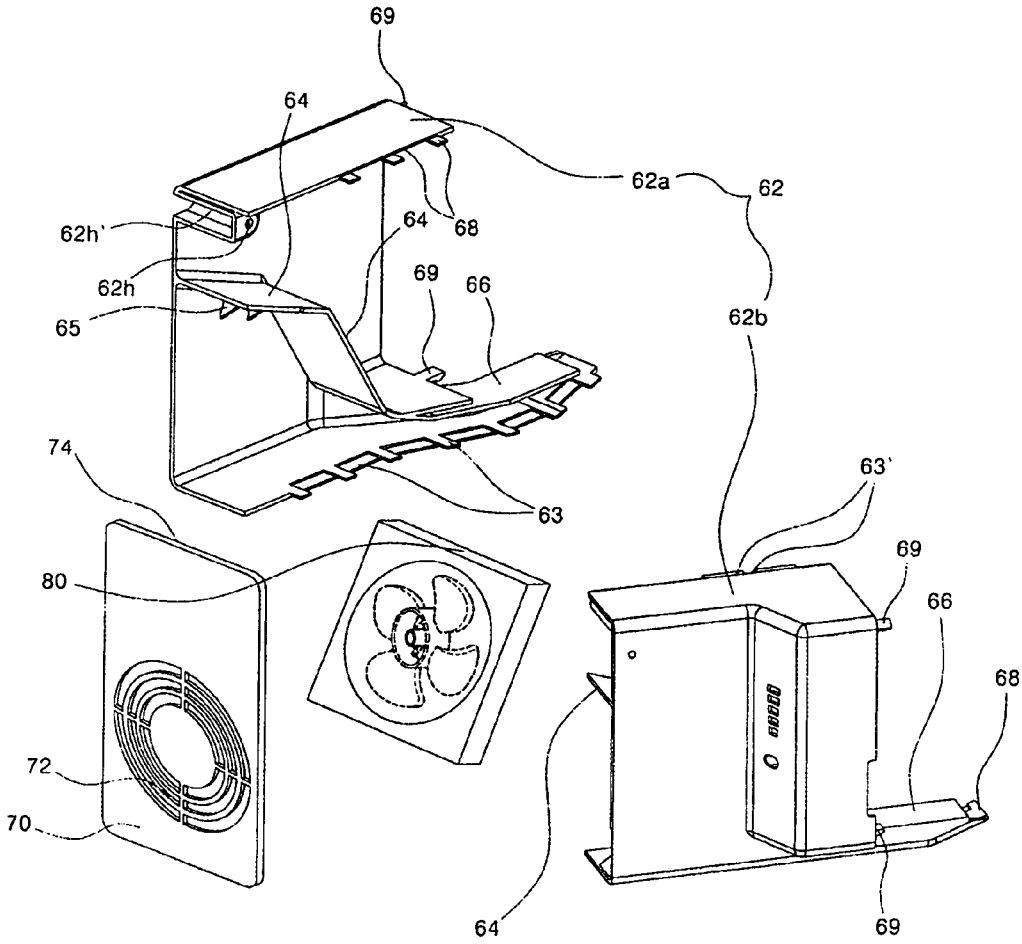
FIG. 5 is an exploded perspective view of the fan assembly in the embodiment of the present invention.
Figure 6:
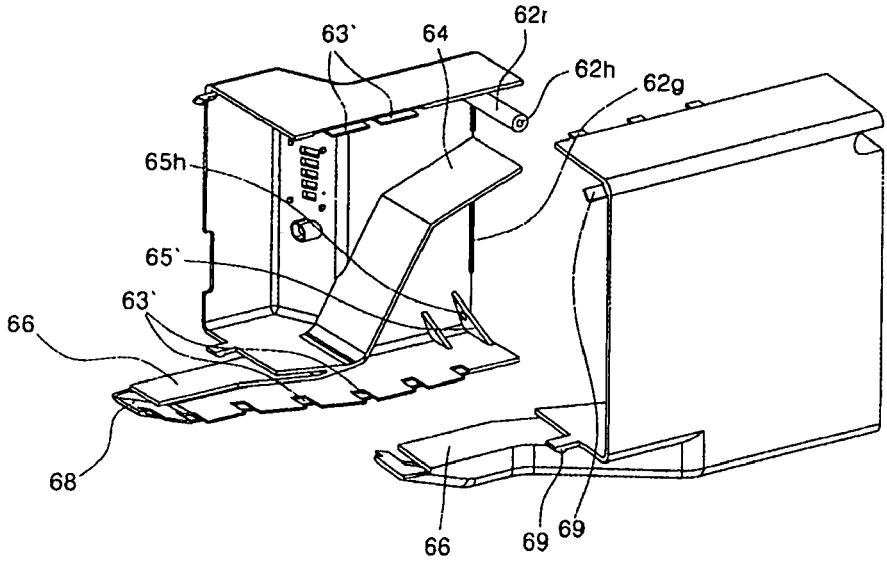
FIG. 6 is an exploded perspective view of a housing in the embodiment of the present invention.
Figure 7A:
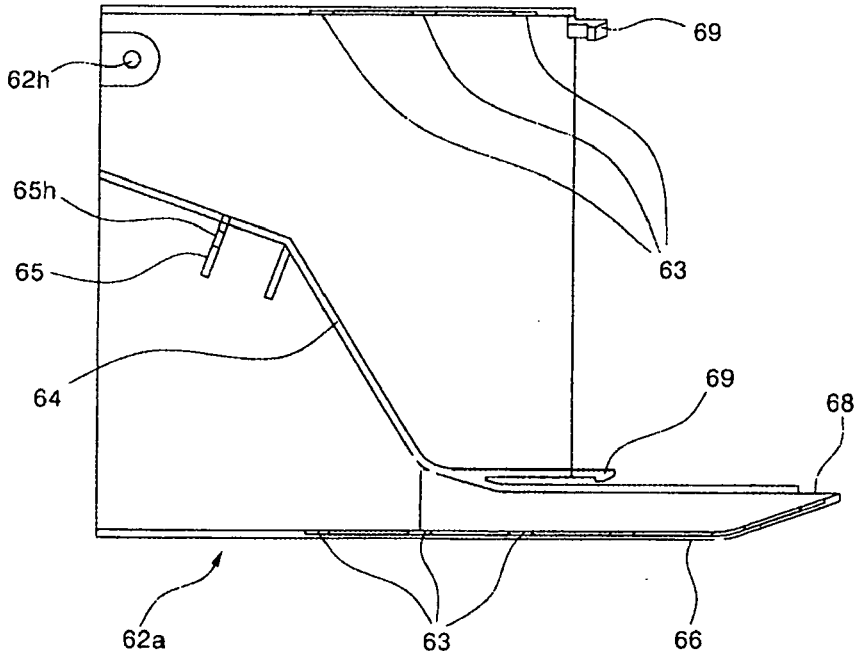
FIG. 7*a* is a side view of a first housing portion in the embodiment of the present invention.
Figure 7B:
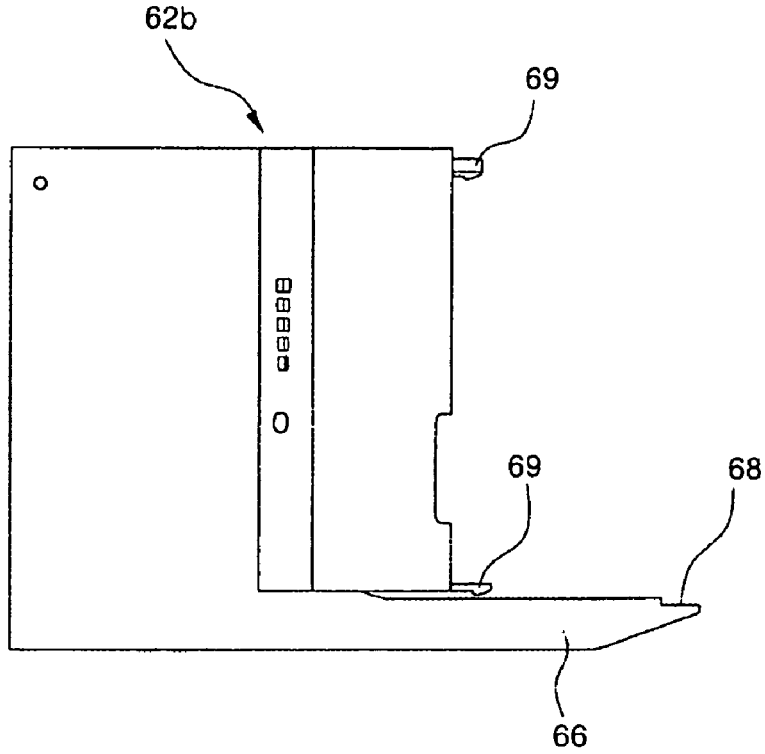
FIG. 7*b* is a side view of a second housing portion in the embodiment of the present invention.
Figure 8:
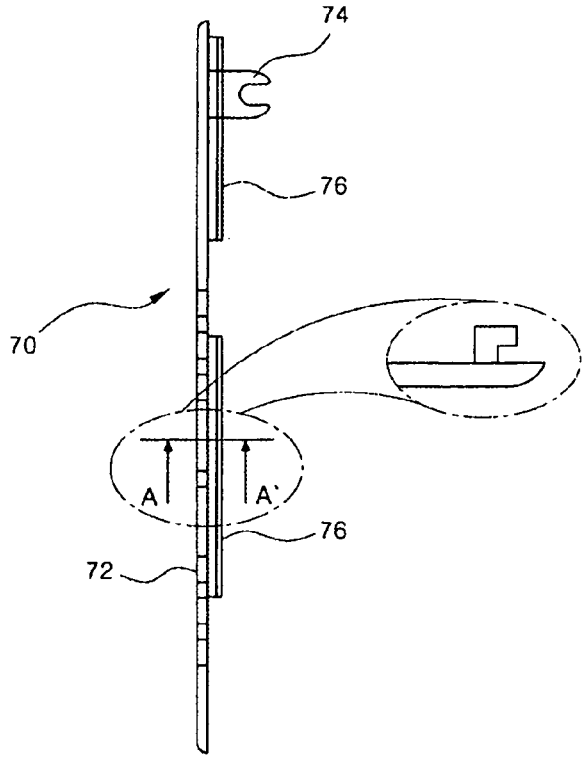
FIG. 8 is a side view of a housing cover in the embodiment of the present invention.

Partition plates 64 are provided in the interiors of the first and second housing portions 62*a* and 62*b*, respectively. When the first and second housing portions 62*a* and 62*b* are coupled to each other, the partition plates 64 partition the interiors of the first and second housing portions 62*a* and 62*b* to form a flow passage 64*f* through which cold air flows. As shown in FIG. 4, the flow passage 64*f* is formed such that its sectional flow area gradually decreases from an upstream side to a downstream side.

Mounting ribs 65 are formed on the partition plate 64 of the first housing portion 62*a*. The mounting ribs 65 are used for mounting a box fan unit 80 which will be described later. Fastening holes 65*h* are perforated in the mounting ribs 65. Further, mounting ribs 65' for mounting the box fan unit 80 are formed at an inner lower end of the second housing portion 62*b*. The mounting ribs 65 and 65' are formed at positions corresponding to opposite corners of the box fan unit 80 and are in pairs to accommodate both ends of relevant external corners of the box fan unit 80. Mounting holes 65 are also formed in the mounting ribs 65'.

An elongated half portion is formed at each of the first and second housing portions 62*a* and 62*b* to form a discharge duct 66 communicating with the flow passage 64*f*. That is, the discharge duct 66 is constructed through coupling of the both half portions formed at the first and second housing portions 62*a* and 62*b* and defines one flow passage in the housing. For reference, the concavo-convex combining parts 63 and 63' are formed even at the discharge duct 66. An outlet 68 is formed at a distal end of the discharge duct 66. The discharge duct 66 extends such that the outlet 68 is located at a position below a side of the ice-making tray 45. Here, as well shown in FIG. 4, a bottom surface of the cold air flow passage 64*f* which is formed in the housing 62 is flush with a bottom surface of the discharge duct 66 to be in a plane. Further, the distal end of the discharge duct 66 is inclined upward toward the bottom of the ice-making tray 45.

A plurality of mounting hooks 69 are formed at the first and second housing portions 62*a* and 62*b* for mounting the housing 62 to the main body frame 41. Since each mounting hook 69 has elasticity due to features of the shape and material thereof, the housing 62 is mounted to the main body frame 41. The mounting hooks 69 are formed at upper side corners of the first and second housing portions 62*a* and 62*b* and portions thereof just above the discharge duct 66. For reference, recesses (not shown) for accommodating the mounting hooks 69 are formed at corresponding positions in the main body frame 41.

The housing 62 is formed such that both ends thereof, that is, an end facing the main body frame 41 and the other end opposite thereto, are open. The housing cover 70 closes the other end opposite to the main body frame 41. The housing cover 70 is formed with an inlet 72 for allowing the flow passage 64 to communicate with the outside.

A fastening rib 74 is formed on a side of the housing cover 70 to correspond to the fastening rib 62*r* of the second housing portion 62*b*. The fastening rib 74 is a portion that is fastened together with the fastening hole 62*h* in the recess and the fastening hole 62*h* of the fastening rib 62*r* for coupling of the first and second housing portions 62*a* and 62*b* by means of a screw. A hanging rib 76 which is hung on the catching rib 62*g* of the second housing portion 62*b* is formed on the housing cover 70. The hanging rib 76 is constructed of separate two portions to prevent interference of the hanging rib 76 with the partition plates 64. The hanging rib 76 is formed to take the shape of "¬" and hung on the catching rib 62*g* so that the housing cover 70 and the first and second housing portions 62*a* and 62*b* can be assembled provisionally.

The box fan unit 80 is installed within the flow passage 64*f* formed in the first and second housing portions 62*a* and 62*b*. The box fan unit 80 is installed in such a manner that relevant corners thereof are seated between the mounting ribs 65 and 65', and is then fixed by means of additional screws that pass through and are fastened to the fastening holes 65*h*. The box fan unit 80 is provided with a fan that provides power for causing cold air to flow through the flow passage 64*f*. A motor for driving the fan is unitarily installed in the box fan unit 8. The motor is a DC motor using a DC power supply.

Next, the operation of the ice maker with the fan assembly according to the present invention constructed as above will be described in detail.

The process of assembling the fan assembly 60 in the ice maker of the present invention will be first described. The fan assembly 60 that has been assembled is mounted to the main body 40 of the ice maker. That is, the concavo-convex coupling portions 63 and 63' of the first and second housing portions 62*a* and 62*b* are coupled to each other so that the first and second housing portions can be assembled provisionally. At this time, the provisional assembly is performed in a state that the box fan unit 80 is seated between the mounting ribs 65 and 65'.

In such a state, the first and second housing portions 62*a* and 62*b* are not moved relatively in a direction perpendicular to extending directions of the concavo-convex coupling portions 63 and 63', and the housing portions are not arbitrarily separated from each other unless an external force greater than a predetermined value is applied thereto.

In order to fix the box fan unit 80, screws are fastened to the box fan unit 80 through the fastening holes 65*h* of the mounting ribs 65 and 65'. In this state, the first and second housing portions 62*a* and 62*b* have been coupled to each other by means of the screws and the box fan unit 80.

Then, the housing cover 70 is coupled to the housing 62. At this time, the fastening rib 74 is seated in the recess 62*h'* of the first housing portion 62*a* in a state where the hanging rib 76 is hung on the catching rib 62*g*. In such a state, the housing cover 70 closes one end face of the housing 62, i.e. a face opposite to the other end face where the discharge duct 66 is formed. The provisional assembly of the housing cover 70 is completed by coupling the hanging rib 76 to the catching rib 62*g* and seating the fastening rib 74 in the recess 62*h'*. At this time, the outside of the housing 62 and the flow passage 64*f* within the housing communicate with each other through the inlet 72 of the housing cover 70.

When a screw is fastened to the fastening rib 74, the fastening hole 62*h* and the fastening hole 62*h* of the fastening rib 62*r* in such a state, the housing cover 70 is coupled to the housing 62. Through such coupling, the first and second housing portions 62*a* and 62*b* are coupled directly to each other.

As described above, when the first and second housing portions 62*a* and 62*b* and the housing cover 70 are completely assembled, the fan assembly 60 is obtained. Through the assembly process, the half portions for the discharge duct 60 provided in the first and second housing portion 62*a* and 62*b* are coupled to each other to form the single discharge duct 66.

Next, the fan assembly 60 is mounted to the main body frame 41 of the main body 40 of the ice maker. At this time, the fan assembly 60 is mounted to the main body 40 of the ice maker by causing the mounting hooks 69 to be caught in the recesses formed on the first mounting frame portion 42 of the main body frame 41. Parts including the control unit 54 provided on the mounting frame portions 42 and 43 are covered by mounting the fan assembly 60 to the main body 40 of the ice maker so that the parts cannot be viewed from the outside.

Meanwhile, the ice maker 30 provided with the fan assembly 60 described above is mounted onto one side of the interior of the refrigerator by means of the fixing rings 41'. The operation of the ice maker 30 will be described below. Water is supplied to the ice-making tray 45, and ice is made by cold air within the refrigerator. At this time, the cold air within the refrigerator is forcibly delivered and supplied to the bottom of the ice-making tray 45 by the fan assembly 60.

That is, the box fan unit 80 is operated so that the cold air within the refrigerator is supplied to the cold air flow passage 64*f* through the inlet 72. The cold air introduced into the cold air flow passage 64*f* passes through the box fan unit 80 and flows to the discharge duct 66. The cold air that passed through the discharge duct 66 is supplied to the bottom of the ice-making tray 45 through the outlet 68.

Figure 9:
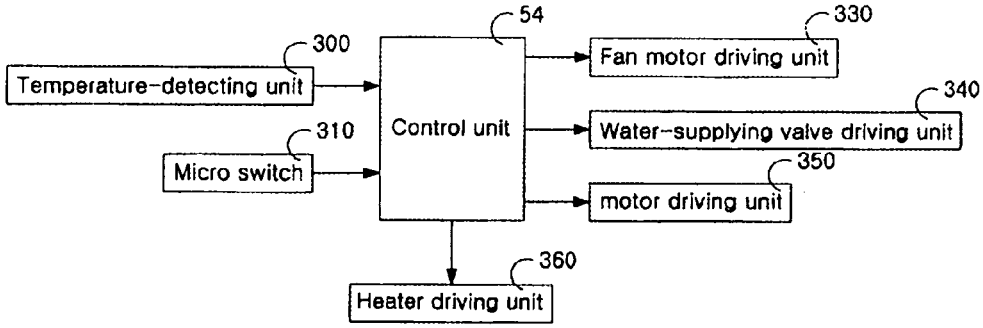
FIG. 9 is a diagram illustrating a configuration for controlling the ice maker with the fan assembly according to the present invention.

Here, a configuration for controlling the ice maker according to the present invention will be described in detail with reference to FIG. 9. The ice maker of the present invention is provided with a water-supplying valve driving unit 340 which is operated when water is supplied to the ice-making tray 45 to make ice. The water-supplying valve driving unit 340 supplies water to the ice-making tray 45 during a period of time for water supply that is monitored by the control unit 54.

A fan motor driving unit 330 is provided to drive the fan for forcibly supplying the cold air toward the ice-making tray 45 so as to facilitate the ice-making operation after supplying the water to the ice-making tray 45. The fan motor driving unit 330 drives the fan under the control of the control unit 54. The fan motor driving unit 330 is constructed such that electric power is applied to the fan motor installed within the box fan unit 80.

The ice maker of the present invention is provided with a temperature-detecting unit 300 which is installed at a side of the ice-making tray 45 to detect temperature as a basic signal for determining whether ice has been made. The temperature detected by the temperature-detecting unit 300 is transmitted to the control unit 54. The control unit 54 checks whether a signal corresponding to the temperature detected by the temperature-detecting unit 300 has reached a predetermined value (value set for determination on a point of time when the process of making ice is completed), and performs control of the ice-releasing operation in response to the determination that the ice-making operation has been completed.

Further, the ice maker of the present invention is provided with a micro switch 310 that is constructed to perform ON/OFF operations in response to the operational state of the ice-detecting lever 48. Operational signals of the micro switch 310 are input into the control unit 54. The control unit 54 receives the signal transmitted from the micro switch 310 and then determines that the ice storage container is fully filled with ice.

Reference numeral 350 designates a motor driving unit. The motor driving unit is a unit for supplying power required for operating the ice-releasing lever 46 for releasing ice from the ice-making tray 45 and the ice-detecting lever 48 for detecting the amount of ice. The motor driving unit 350 is a unit for controlling the supply of electric power to the driving motor 52.

Further, in order to separate ice from the ice-making tray when the ice-releasing operation is performed, a heater 90 (see FIG. 4) is provided at a lower end of the ice-making tray 45. The heater 90 is operated by a heater-operating unit 360 under the control of the control unit 54.

Figure 10:
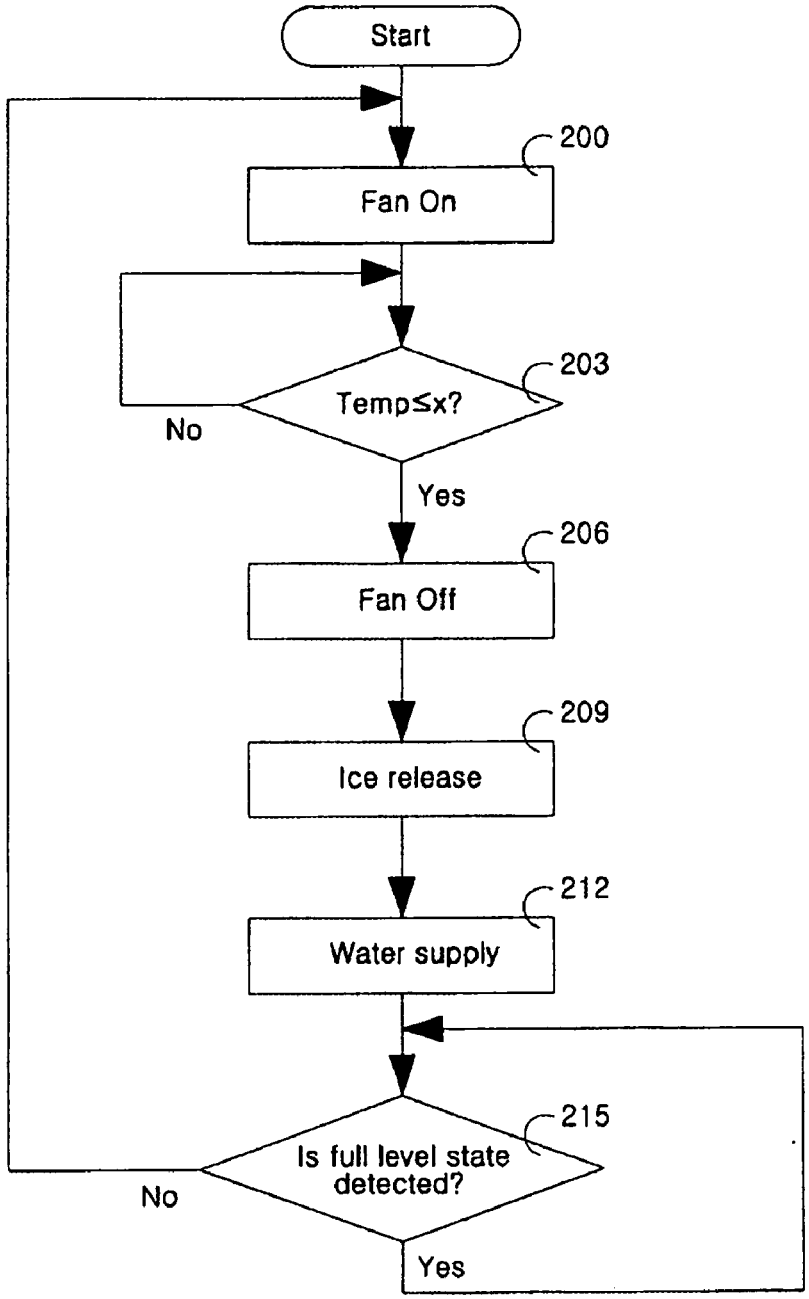
FIG. 10 is a flow chart illustrating operations for controlling a fan in the ice maker according to the present invention.

Next, the process of controlling the operation of the fan in the ice maker according to the present invention will be described. FIG. 10 is a flowchart illustrating the process of controlling the fan in the ice maker according to the present invention.

In the ice maker of the present invention, the fan is controlled to perform the ON/OFF operation of the fan only once during one cycle in which all of the water-supplying operation, the ice-making operation, the ice-releasing operation, and the operation for detecting the state where the ice storage container is fully filled with ice are performed once. Moreover, in the ice maker of the present invention, the fan is operated only when the ice-making operation is being performed.

In a state where water is supplied to the ice-making tray 45, the control unit 54 applies a signal to the fan motor driving unit 330 in order to drive the fan motor installed within the box fan unit 80 (step 200). Due to the control in step 200, the fan motor driving unit 330 allows electric power to be supplied to the fan motor, so that the fan motor within the box fan unit 80 can begin to operate.

When the fan motor begins to operate, the cold air within the refrigerator is supplied to the cold air flow passage 64*f* through the inlet 72. The cold air introduced into the cold air flow passage 64*f* passes through the box fan unit 80 and flows toward the discharge duct 66. The cold air that has passed through the discharge duct 66 is supplied to the bottom of the ice-making tray 45 via the outlet 68.

In such a way, the cold air is supplied rapidly to the ice-making tray 45 and water contained in the ice-making tray 45 is frozen. In the meantime, the control unit 54 controls the operation of the box fan unit 80 and simultaneously monitors temperature through the temperature-detecting unit 300.

The temperature-detecting unit 300 is provided at a side of the ice-making tray 45 and detects the temperature of the ice-making tray 45. This is an operation for monitoring whether water contained in the ice-making tray 45 has been frozen completely. That is, when the water contained in the ice-making tray 45 has been frozen, the temperature of the ice-making tray falls below a certain temperature x. Accordingly, the control unit 54 checks whether the temperature detected by the temperature-detecting unit 300 falls below the certain value x (step 203).

When the condition of step 203 has been satisfied, the control unit 54 determines that the ice-making operation has been completed. Accordingly, the control unit determines that it is not necessary to supply cold air any longer. Thus, the control unit 54 controls the fan motor driving unit 330 to cause the operation of the fan unit 80 to be stopped (step 206).

After the box fan unit 80 is stopped in step 206, the control unit 54 controls the operation for releasing ice from the ice-making tray 45 (step 209). The control unit 54 first supplies electric power to the heater 90 through the heater-driving unit 360 to operate the heater. Since the ice adheres to the ice-making tray 45 as a result of the ice-making operation, the heater 90 is operated to slightly melt the bottom of the ice.

Then, the control unit 54 drives the driving motor 52 through the motor-driving unit 350. The driving motor 52 generates rotational force for rotating the ice-releasing lever 46. The ice-releasing lever 46 pushes the ice in the ice-making tray 45 to the outside of the ice-making tray 45 while being rotated by means of the rotational force generated from the motor 52.

When the ice-releasing operation in step 209 has been completed, the control unit 54 operates the water-supplying valve through the water-supplying valve driving unit 340 so that water can be supplied to the ice-making tray 45 (step 212). Then, the control unit determines through the ice-detecting lever whether the amount of ice that has been already made reaches a full level state, (step 215). Steps 212 and 215 are performed substantially at the same time.

When the amount of ice that has been already made has reached the full level state in step 215, the ice-making operation is no longer performed. That is, the full level state represents a state where the ice storage container additionally provided below the ice-making tray 45 is fully filled with the ice. Accordingly, if ice is made continuously even when the full level state is detected, a space for storing ice in the container is lacked.

Therefore, until the full level state is released, step 215 is in a standby state in which any of the ice-making operation, the ice-releasing operation and the water-supplying operation is not performed. When the full level state is released because a user takes out ice from the container, the procedure is returned back to step 204 and thus the control unit 54 repeats the aforementioned operations.

At this time, since water has been already supplied to the ice-making tray 45 in step 212, the box fan unit 80 is operated again to perform the ice-making operation. When the ice-making operation has been completed, the ice-releasing operation is performed.

In the present invention described above, the box fan unit 80 is turned on/off only once during one cycle in which all of the ice-making operation, the ice-releasing operation, the water-supplying operation and the operation for detecting the full level state are performed once. Particularly, since the box fan unit 80 is turned on only when the ice-making operation is performed, it is possible to prevent the box fan unit 80 from being unnecessarily operated during other operations. Therefore, the present invention operates the fan assembly once during one cycle, thereby reducing unnecessary operations.

Further, in the embodiment of the present invention, when the ice maker is operated initially, it is necessary that a user supplies water to the ice-making tray 45 by himself/herself. This is because in the present invention, the water-supplying operation is performed after performing the ice-making operation and the ice-releasing operation. However, after the ice-making operation and the ice-releasing operation have been performed once, the water-supplying operation is automatically performed in step 212.

INDUSTRIAL APPLICABILITY

According to the present invention described above, the number of parts constituting the fan assembly is relatively decreased, and the number of screws for fastening the parts is also minimized. In the embodiment illustrated in the figures, only three (3) screws are used to assemble the fan assembly and the fan assembly is mounted to the main body frame without an additional screw. Accordingly, there are advantages in that the number of the parts constituting the ice maker is decreased as a whole and assembly workability is greatly improved.

Furthermore, in the ice maker of the present invention, since the number of parts constituting the fan assembly is decreased and a relatively light DC motor is used, the center of gravity of the ice maker is adjacent to the geometrical center thereof so that the design of a structure for mounting the ice maker to the interior of a refrigerator can be simplified.

Next, a cold air stream formed within the fan assembly in the present invention is in the form of a straight line, so that cold air can be supplied rapidly and smoothly to the ice-making tray without flow loss.

In the meantime, according to the method of controlling the ice maker, the fan is operated only when the ice-making operation is performed, and the control unit determines whether the operation of the fan will be performed again after checking ice release, water supply and the full level state of ice while maintaining the fan in a stopped state before the ice-releasing operation is performed. Accordingly, since the fan assembly is operated only once during one cycle to avoid unnecessary operations, there is an advantage in that the life of the fan can be prolonged.

The invention claimed is:

1. An ice maker having a fan assembly, comprising:

a main body constructed such that an ice-making tray in which ice is made is pivotably supported to a main body frame of the main body; and a fan assembly mounted to the main body frame of the main body to supply cold air to the ice-making tray, the fan assembly comprising:

a housing including first and second housing portions of which the interiors are partitioned by partition plates to define a cold air flow passage and which form a discharge duct that communicates with the cold air flow passage to supply the cold air to the ice-making tray;

a box fan unit which is fixed in the cold air flow passage defined within the first and second housing portions while coupling the first and second housing portions to each other and supplies power for forcibly delivering the cold air; and mounting hooks for resiliently hanging and mounting the first and second housing portions on the main body frame.

2. The ice maker as claimed in claim 1, wherein the first and second housing portions have concavo-convex coupling portions formed such that concave and convex portions of one of the first and second housing portions correspond to convex and concave portions of the other housing portion, thereby setting relative positions of the housing portions and provisionally assembling the housing portions.

3. The ice maker as claimed in claim 2, wherein the housing comprising the first and second housing portions is provided with a housing cover on a side thereof opposite to the main body frame, and the housing cover is formed with an inlet to supply the cold air to the cold air flow passage.

4. The ice maker as claimed in any one of claims 1 to 3, wherein each of the first and second housing portions is provided with mounting ribs for fixing the box fan unit, and the first and second housing portions are coupled to each other by fixing the box fan unit to the mounting ribs.

5. The ice maker as claimed in claim 4, wherein one of the housing portions of the housing is formed with a recess that has a fastening hole formed therethrough, and the housing cover is provided with a fastening rib which is seated in the recess and fastened by means of a screw that passes though the fastening hole and is fastened to the other housing portion.

6. The ice maker as claimed in claim 5, wherein the housing cover has a hanging rib formed at one side thereof and a catching rib is formed on the housing at a position corresponding to the hanging rib such that the hanging rib can be hung on the catching rib, and the housing cover is guided to an installation position thereof as the fastening rib is seated in the recess of the housing portion.

7. The ice maker as claimed in claim 6, wherein the inlet formed in the housing cover, the flow passage defined within the housing, and the discharge duct and an outlet thereof exist on a straight line.

* * * * *